US010427122B1

(12) United States Patent
Tapocik

(10) Patent No.: US 10,427,122 B1
(45) Date of Patent: Oct. 1, 2019

(54) DISPOSABLE PRE-FILLED HAND-OPERATED DUAL CHAMBER PRODUCT DISPENSING APPARATUS

(71) Applicant: Bryan Tapocik, Highland, CA (US)

(72) Inventor: Bryan Tapocik, Highland, CA (US)

(73) Assignee: Innovative Product Brands, Inc., Highland, CA (US)

( * ) Notice: Subject to any disclaimer, the term of this patent is extended or adjusted under 35 U.S.C. 154(b) by 0 days.

(21) Appl. No.: 15/952,047

(22) Filed: Apr. 12, 2018

Related U.S. Application Data

(60) Provisional application No. 62/573,295, filed on Oct. 17, 2017.

(51) Int. Cl.

| | |
|---|---|
| ***B01F 15/02*** | (2006.01) |
| ***B05C 17/005*** | (2006.01) |
| ***B01F 5/06*** | (2006.01) |
| ***B01F 15/00*** | (2006.01) |
| ***B05C 17/01*** | (2006.01) |

(52) U.S. Cl.
CPC ..... *B01F 15/0237* (2013.01); *B01F 5/0618* (2013.01); *B01F 15/0087* (2013.01); *B01F 15/0226* (2013.01); *B05C 17/00503* (2013.01); *B05C 17/00553* (2013.01); *B05C 17/0133* (2013.01); *B01F 2005/0637* (2013.01); *B01F 2215/0039* (2013.01)

(58) Field of Classification Search
CPC ..... B01F 15/0237; B01F 15/0226; B01F 15/0087; B01F 5/0618; B01F 2215/0618; B01F 2005/0637; B05C 17/00553; B05C 17/00503
USPC .... 222/145.6, 135, 132, 136–142, 489, 387; 604/207–222
See application file for complete search history.

(56) References Cited

U.S. PATENT DOCUMENTS

| | | | | |
|---|---|---|---|---|
| 4,240,566 | A * | 12/1980 | Bergman | B05C 17/00516 206/219 |
| 5,111,972 | A * | 5/1992 | Sakurai | A45D 40/0075 222/135 |
| 8,298,194 | B2 * | 10/2012 | Moller | A61M 5/24 604/181 |
| 8,590,747 | B2 * | 11/2013 | Keller | A61B 17/00491 222/137 |
| 2006/0071024 | A1 * | 4/2006 | Vrus | A45D 19/0008 222/137 |
| 2007/0072146 | A1 * | 3/2007 | Pierson | A61C 9/0026 433/90 |

* cited by examiner

*Primary Examiner* — Lien M Ngo
(74) *Attorney, Agent, or Firm* — Thomas I. Rozsa

(57) ABSTRACT

A manual mixing apparatus that contains two dual chambers with each of the chambers containing a separate and distinct chemical or liquid. Further, the apparatus has a rotatable base that allows the chemicals to be forced out of a nozzle as the base is rotated through a pair of expansion members respectively affixed to moving rear walls which move longitudinally to push a respective chemical into a front mixing tip from which the combined chemicals are discharged.

17 Claims, 11 Drawing Sheets

DISPOSABLE PRE-FILLED HAND-OPERATED DUAL CHAMBER PRODUCT DISPENSING APPARATUS

CROSS-REFERENCE TO RELATED APPLICATION

This patent application claims priority to Provisional Application Ser. No. 62/573,295 filed on Oct. 17, 2017.

BACKGROUND OF THE INVENTION

1. Field of the Invention

The field of the invention relates to substance mixers. Specifically, the present invention relates to substance mixing apparatus that are manually operated and mix two chemicals into one compound for dispensing out of a nozzle.

2. Description of the Prior Art

At the time the provisional patent application was filed, the inventor was not aware of any prior art which identically disclosed the present invention or which would make the present invention obvious. As of the filing date of this non-provisional patent application, the inventor is still not aware of any prior art which identically disclosed the present invention or which would make the present invention obvious.

SUMMARY OF THE INVENTION

The present invention is a manual mixing apparatus that allows the mixing of substances that are initially within separate chambers and then are mixed together to form a combined substance for dispensing out of a nozzle.

It is an object of the present invention to provide a disposable apparatus that contains two parallel separated chambers with each of the chambers containing a separate and distinct substances. It is also within the spirit and scope of the present invention for the apparatus to be reusable after sterilization.

It is also an object of the present invention to provide a rotating base that interacts with a respective pair of rotating gears which cause a respective expander to respectively push a movable sealing wall to push each respective material in aligned but separated chambers to be pushed into a mixing tip from which the combined materials are pushed out of an opening in a nozzle.

It is a further object of the present invention to provide a mixing sleeve to allow the substances such as chemicals or liquids to mix just prior to exiting out of the mixing tip and nozzle for application of the combined substance.

It is still a further object of the present invention to provide two internal gears that expand as the bottom base is rotated to force the movable walls, which can be considered to be pistons, towards the nozzle and further force each of the respective chemicals or liquids within the interior chambers towards the nozzle.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
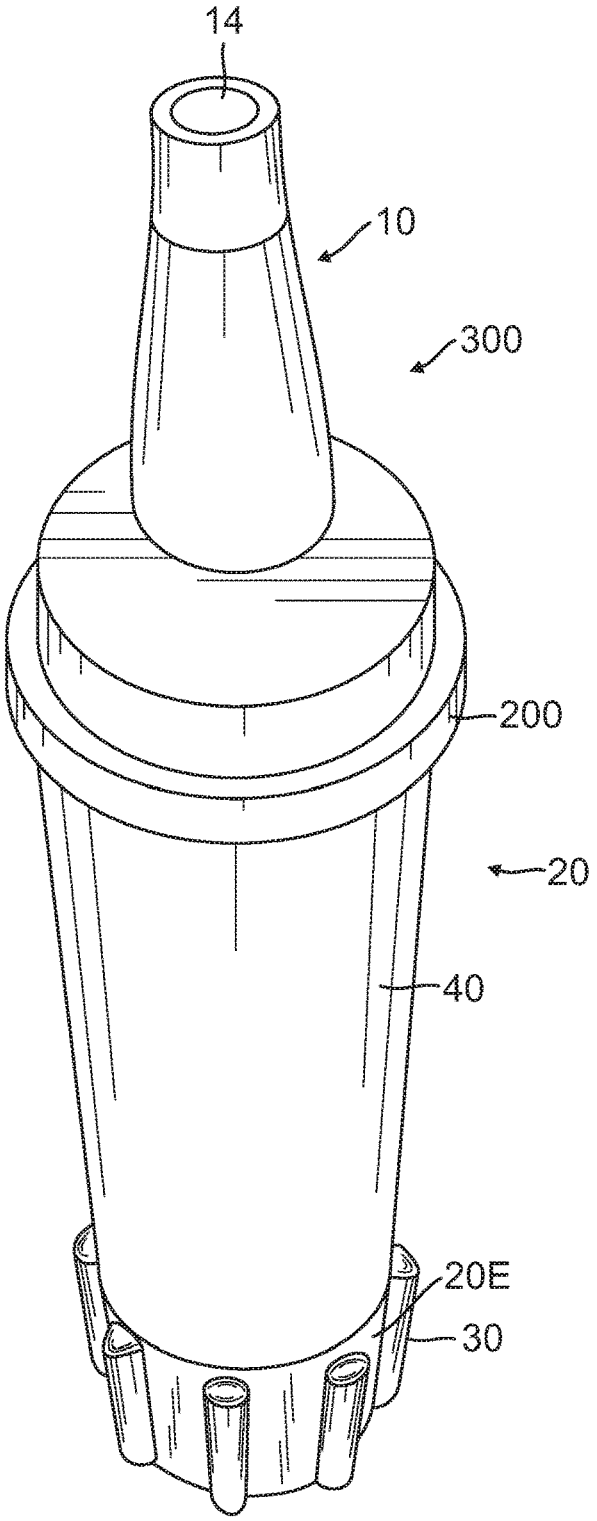
FIG. 1 is a front perspective view of the disposable pre-filled hand-operated dual chamber product dispensing apparatus with a cap removed, illustrating the nozzle on top and the present invention resting on the rotatable base.

Referring to FIG. 1, there is illustrated a front perspective view of the hand-operated dual chamber product dispensing apparatus 300 with a cap removed exposing the nozzle 10 on top and the present invention resting on the rotatable base. The nozzle 10 is affixed to the central section 20 at its distal end 20D (see FIG. 2). The proximal end 20E of central section 20 is closed by a rotatable base 30. The nozzle 10 is press fit retained to central section 20. The apparatus 300 is preferably a disposable pre-filled hand-operated dual chamber product dispensing apparatus. However, it is within the spirit and scope of the present invention for the apparatus to be re-usable and filled before use. The nozzle 10 is integrally formed with a mating collar 200 by which the nozzle 10 is press fit retained onto the front end 20D of main body 20. It will appreciated that if a cap 18 (see FIG. 10A) is used, it will be a central cylindrical cap which fits over the nozzle 10 and is retained on the collar 200.

Referring to FIG. 1, there is illustrated a front perspective view of the disposable pre-filled hand-operated dual chamber product dispensing apparatus 300 with the cap removed. With the cap removed, a central opening 14 in the nozzle 10 enables a mixed compound to be dispensed from the apparatus 300.

Figure 2:
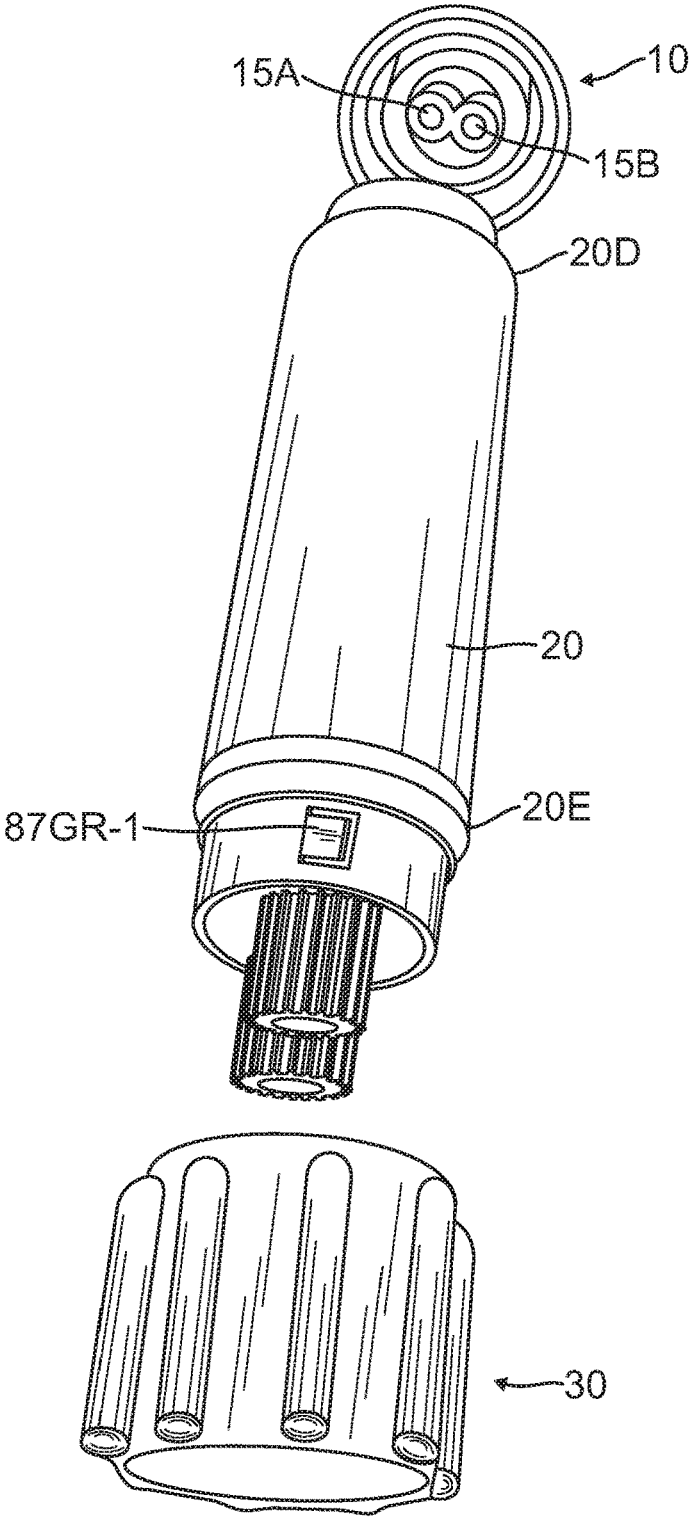
FIG. 2 is an exploded view of the present invention illustrating the nozzle removed from a front end of the main central section, the main central section rotated to illustrate the mixing gears and the hand-operated base removed from the rear of the main central section, illustrating a first gear engaging clip.

Referring to FIG. 2, there is illustrated is an exploded view of the present invention 300 illustrating the nozzle 10 removed from a front end 20D of the main central section 20, the main central section rotated to illustrate the mixing gears and the hand-operated base 30 removed from the rear 20E of the main central section 20, illustrating a first gear retaining clip 87GR-1. The mixing chamber entrance openings 15A and 15B at the base of the nozzle 10 are also illustrated.

Figure 3:
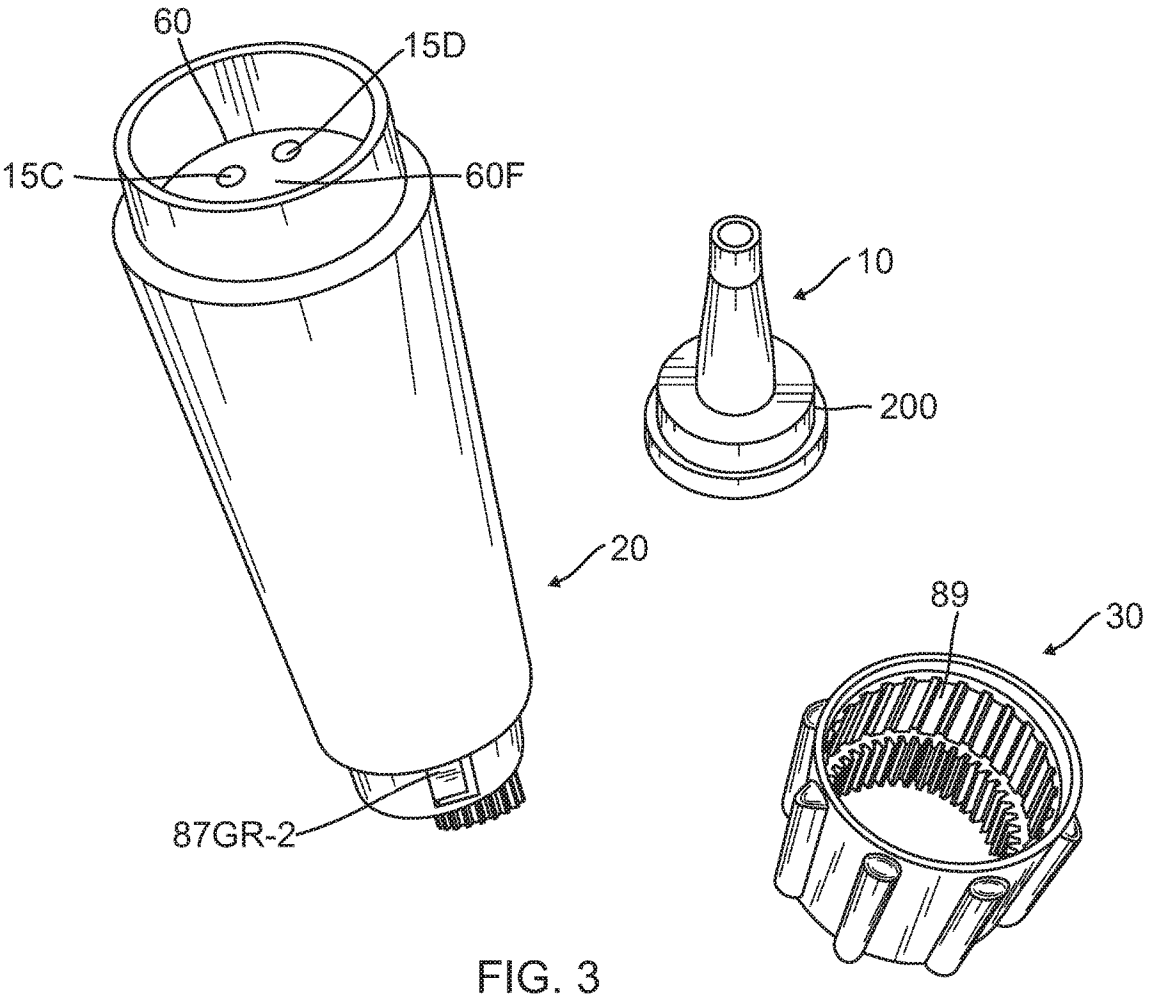
FIG. 3 is a component separated view of the present invention illustrating from left to right, an exterior side-perspective view of the main body of the present invention with the nozzle removed from the front end to illustrate the mixing chamber adjacent to mixing nozzle and rotated 180 degrees to illustrate the second engaging clip, and the hand-operated base removed from the rear of the main body.
Figure 10A:
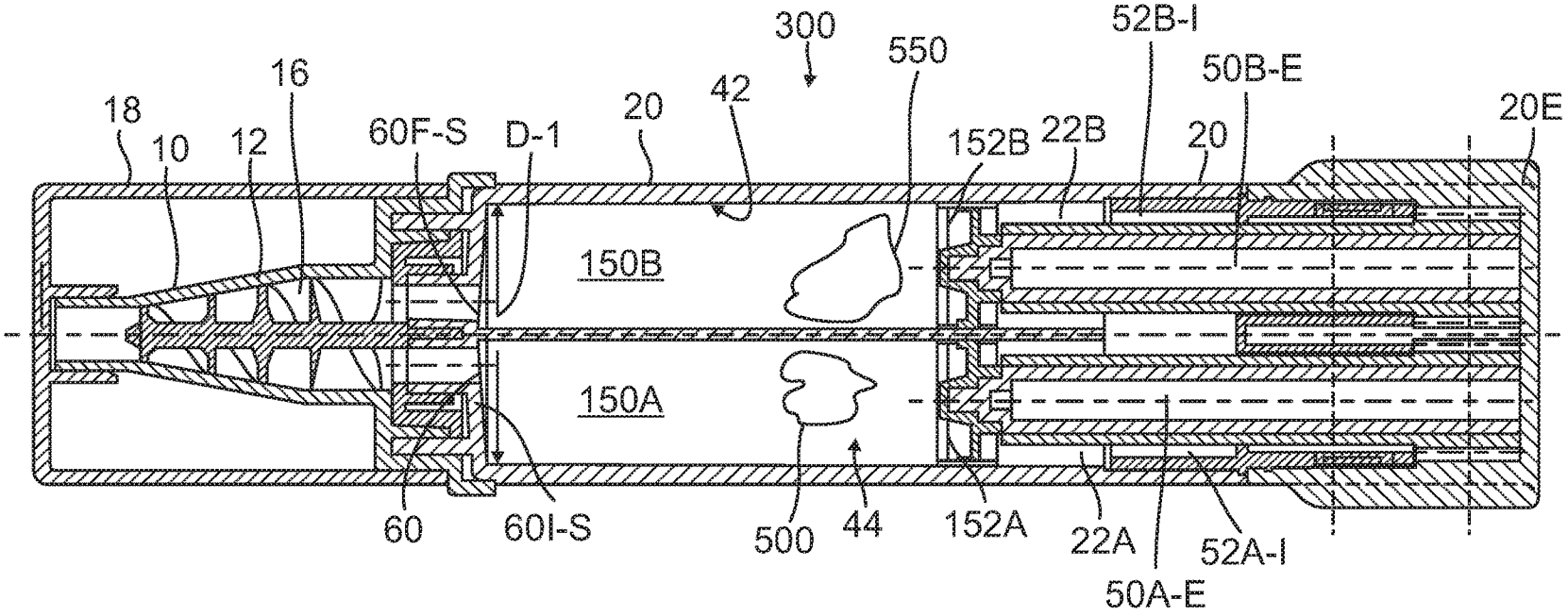
FIG. 10A is a cross-sectional view of the present invention hand dual chamber illustrating the liquid or chemical storage sections located between the nozzle section and the expandable gears.

Referring to FIG. 3, there is illustrated a separated view of the present invention 300, illustrating the nozzle 10 removed from a front end 20D of the main central section 20, the main central section rotated 180 degrees from the view in FIG. 2, to illustrate the second gear retaining clip 87GR-2. The exit openings 15C and 15D from the front interior end of the main body, which are respectively aligned with mixing chamber entrance openings 15A and 15B, of nozzle 10 are also illustrated. First gear retaining clip 87GR-1 is 180 degrees opposite to second gear retaining clip 87GR-2. The nozzle 10 includes a mixing members 16 as illustrated in FIG. 10A. The concepts of parallel chambers including separate substances which are separated by a longitudinal barrier which are forced out of their respective chambers into respective openings such as 15C and 15D which are forced into entrance-openings 15A ad 15B into mixing blades 16 where the two substances are mixed and released out of an opening 14 in the nozzle 10 is a previously developed concept. The present inventor is the inventor of innovative mechanical and electrical inventions which include a cartridge which contains separated substances. The innovation of the present invention is the hand operated apparatus which create the moving force to push substances from divided chambers to the mixing nozzle.

Figure 4A:
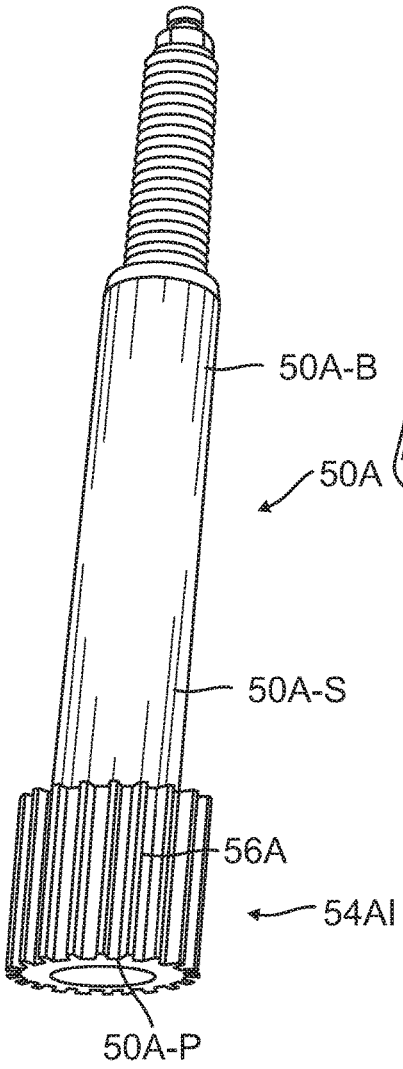
FIG. 4A is a side perspective view of the first of the two expandable gears of the present invention.
Figure 4B:
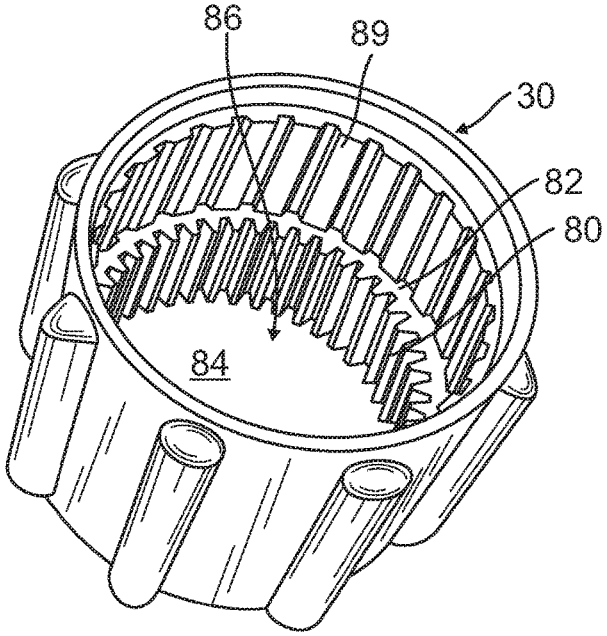
FIG. 4B is a top perspective view of the rotatable base illustrating the internal main body engaging threads to be retained by the mating clip on the first main body and also illustrating first engaging gears which mate with the first engaging gears of the top first gear body.
Figure 7A:
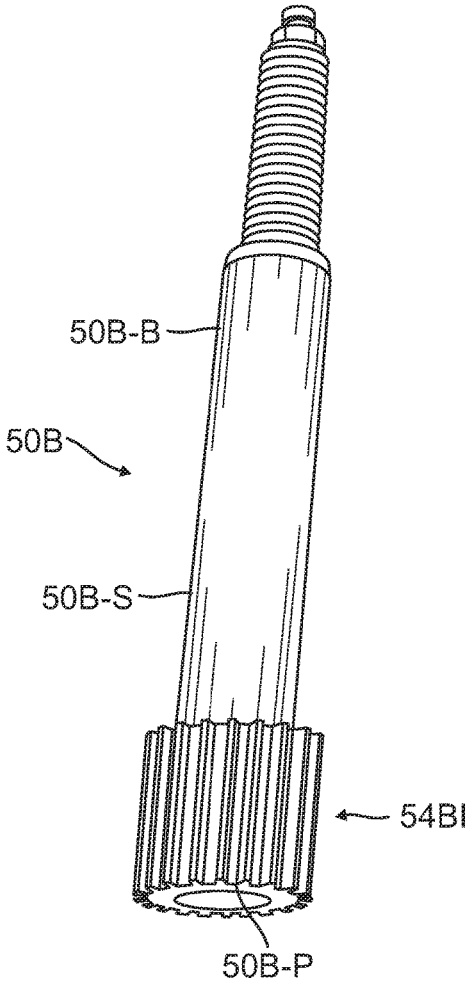
FIG. 7A is a side perspective view of the second of the two expandable gears of the present invention.
Figure 7B:
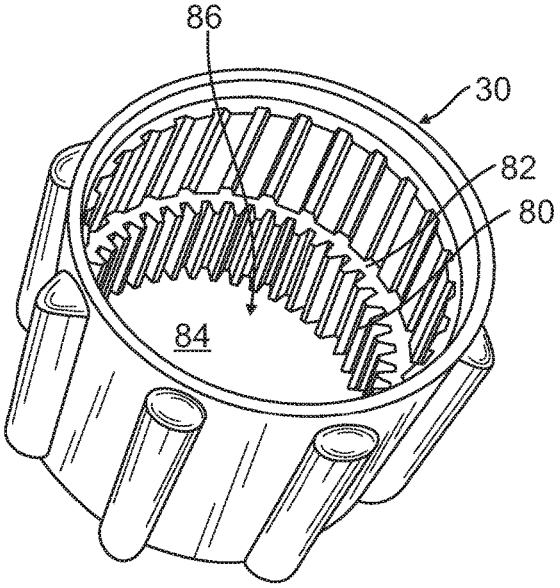
FIG. 7B is a top perspective view of the second rotatable base illustrating the internal main body engaging threads to be retained by the mating clip on the main body and also illustrating first engaging gears which mate with the first engaging gears of the top first gear body.

As illustrated in FIGS. 4B and 7B, rotatable base 30 includes upper circumferential engaging gears or teeth 89. The main body 20 and base 30 are rotatably retained together through first gear retaining clip 87GR-1 and second gear retaining clip 87GR-2 engaging upper circumferential engaging teeth 89 when proximal end 20E of the main body 20 is inserted into rotatable base 30.

Figure 8:
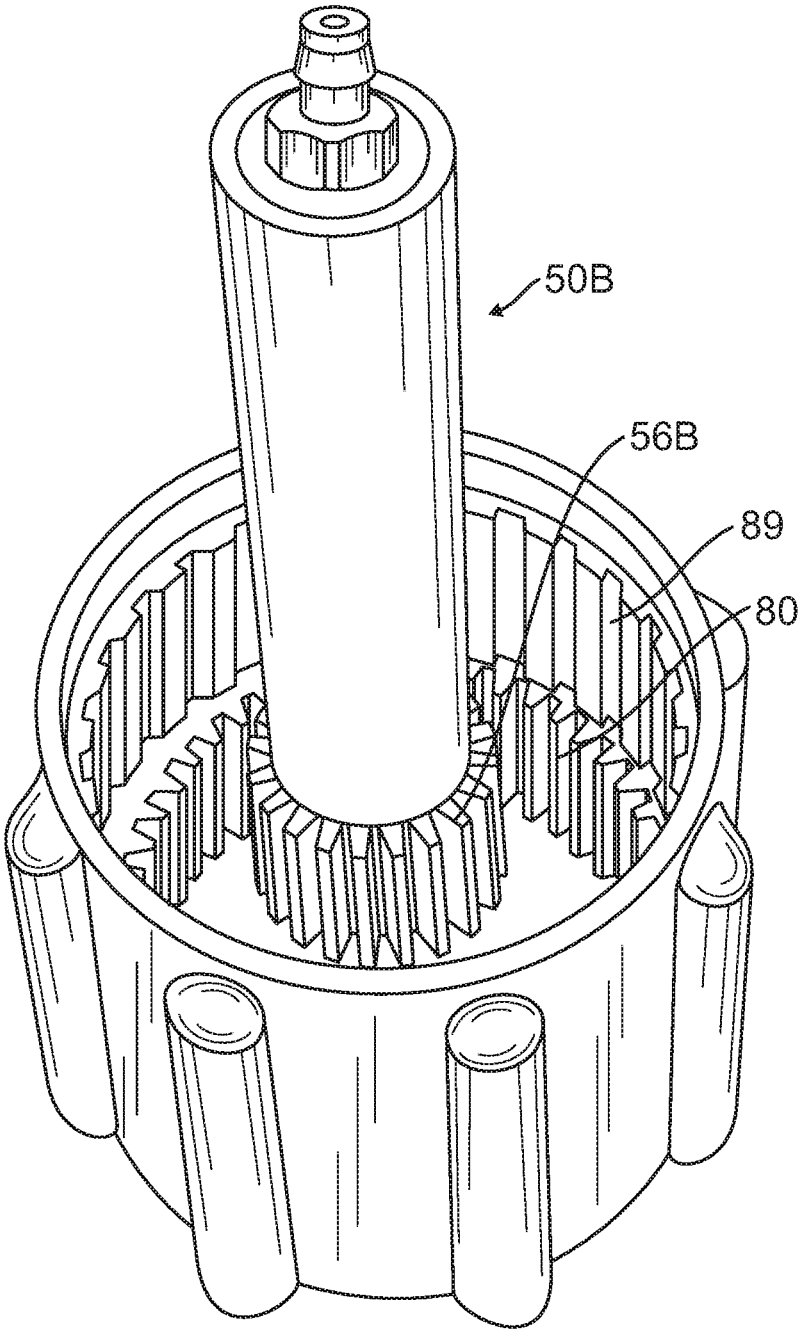
FIG. 8 is a top interior perspective view of the second of two expandable gears positioned inside of the rotatable base with the threaded section of the expandable gear contained entirely within the expandable gear and the threaded base of the expandable gear engaged with interior threaded gear threads in the rotatable base.
Figure 9:
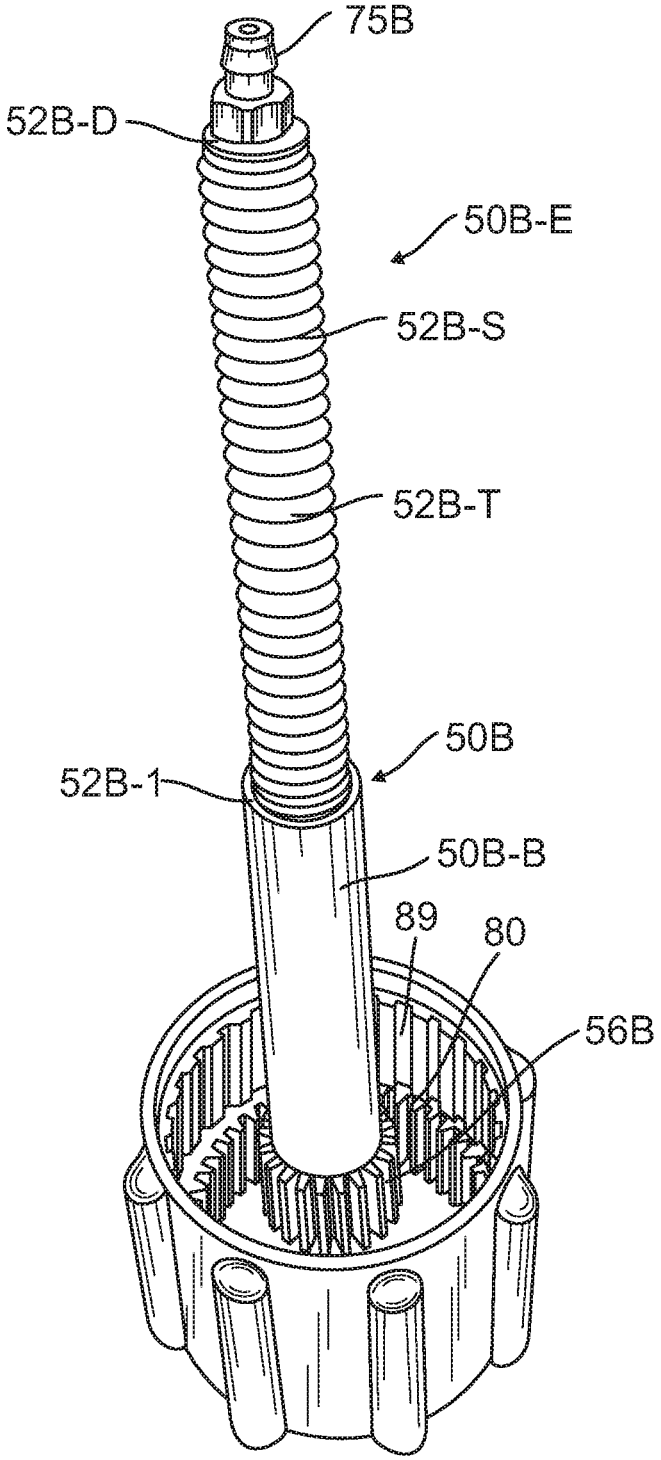
FIG. 9 is a top interior perspective view of the second expandable gear positioned inside of the rotatable base with the threaded section of the second expandable gear fully extended out of the expandable gear and the threaded base of the second expandable gear engaged with interior threads in the rotatable base and also illustrating the approximate distance each longitudinal movable wall will traverse inside of central main section.
Figure 10B:
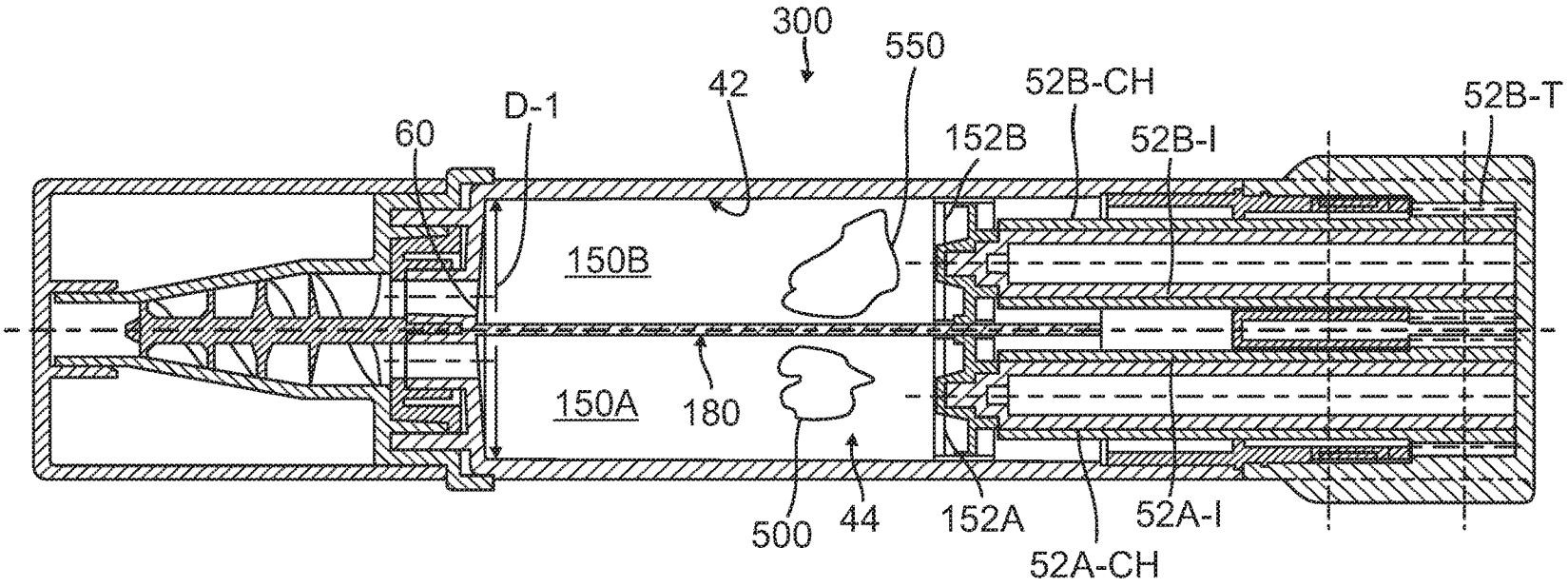
FIG. 10B is a duplicate of FIG. 10 which is a cross-sectional view of the present invention hand dual chamber illustrating the liquid or chemical storage sections located between the nozzle section and the expandable gears, the duplicate used to facilitate part numbering.

The details of the specific elements of the present invention are illustrated in FIGS. 1 through 9 and FIG. 10A and identical FIG. 10B. For a better understanding of the invention, the operation of the present invention in FIGS. 10A and 10B will now be described.

Referring to FIG. 10A, there is illustrated a cross-sectional view of the present invention hand-operated dual chamber illustrating the liquid or substance storage sections of the present invention located between a nozzle section and expandable gears. To provide more space to place numbers in this illustration of the present invention, FIG. 10A has been duplicated in FIG. 10B. The present invention hand-operated dual chamber product dispensing apparatus 300 (see FIG. 1) includes a cylindrically shaped main body, also referred to as central section 20, having an exterior wall 40 with a cylindrical interior surface 42 surrounding an interior chamber 44. Within interior chamber 44 there are two parallel interior product dispensing chambers 150A and 150B separated by a centrally located longitudinal interior dividing wall 180 which extends from adjacent the interior surface 60I-S at the interior front surface 60 to between two longitudinally movable rear walls 152A and 152B. The longitudinal interior dividing wall 180 extends transversely for the entire interior diameter D-1 of interior chamber. Therefore, the central section includes two separate interior product dispensing chambers. The first interior product dispensing chamber 150A is bounded by one half of interior surface 42, the interior dividing wall 180, the first longitudinally movable rear wall 152A and the front interior surface 60F-S of interior front wall 60F including opening 15C. The second interior product dispensing chamber 150B is bounded by one-half of interior surface 42, the interior dividing wall 180, the second longitudinally movable rear wall 152B and the interior surface 60I-S of the front interior wall 60 in interior opening 15D. In one preferred embodiment, the interior surface 42 is cylindrical and the interior dividing wall 180 is a straight planar surface. Therefore, in this preferred embodiment, the first longitudinally movable rear wall 152A is semi-circular shaped and the second longitudinally movable rear wall 152B is also semi-circular shaped. A first product 500 is inserted into first interior product dispensing chamber 150A and a second product 550 is inserted into second interior product dispensing chamber 150B before each chamber is sealed by a respective longitudinally movable rear wall 152A or 152B. As will be described, each respective longitudinally movable rear wall, 152A and 152B, is simultaneously pushed forward into each respective first interior product dispensing chamber 150A and second interior product dispensing chamber 150B, and each first product 500 and second product 550 are respectfully pushed through openings 15C and 15D into respective openings 15A and 15B into mixing member 18 where they are mixed together and pushed out through a longitudinal interior opening 14 in nozzle 10.

The products 500 and 550 can be any two elements, components, ingredients, or other substances which need to be initially separated and react together when combined. By way of example, products 500 and 550 are selected from the group consisting of tooth whitening compounds, nail polish, cosmetic products, hair coloring, non-prescription supplements, prescription medicines, caulking compounds, paint compounds and varnish compounds.

Referring to FIGS. 1 through 10B, there is illustrated the present invention disposable pre-filled hand-operated dual chamber product dispensing apparatus 300, having a top nozzle 10, a central section 20 and a bottom rotatable base 30. Inside central section 20, there are two gear chambers 22A and 22B (see FIG. 10A). Gear chamber 22A is shown with expandable gear 50A (see FIG. 4A) retained therein and gear chamber 22B is shown with expandable gear 50B (see FIG. 7A) retained therein.

Figure 5:
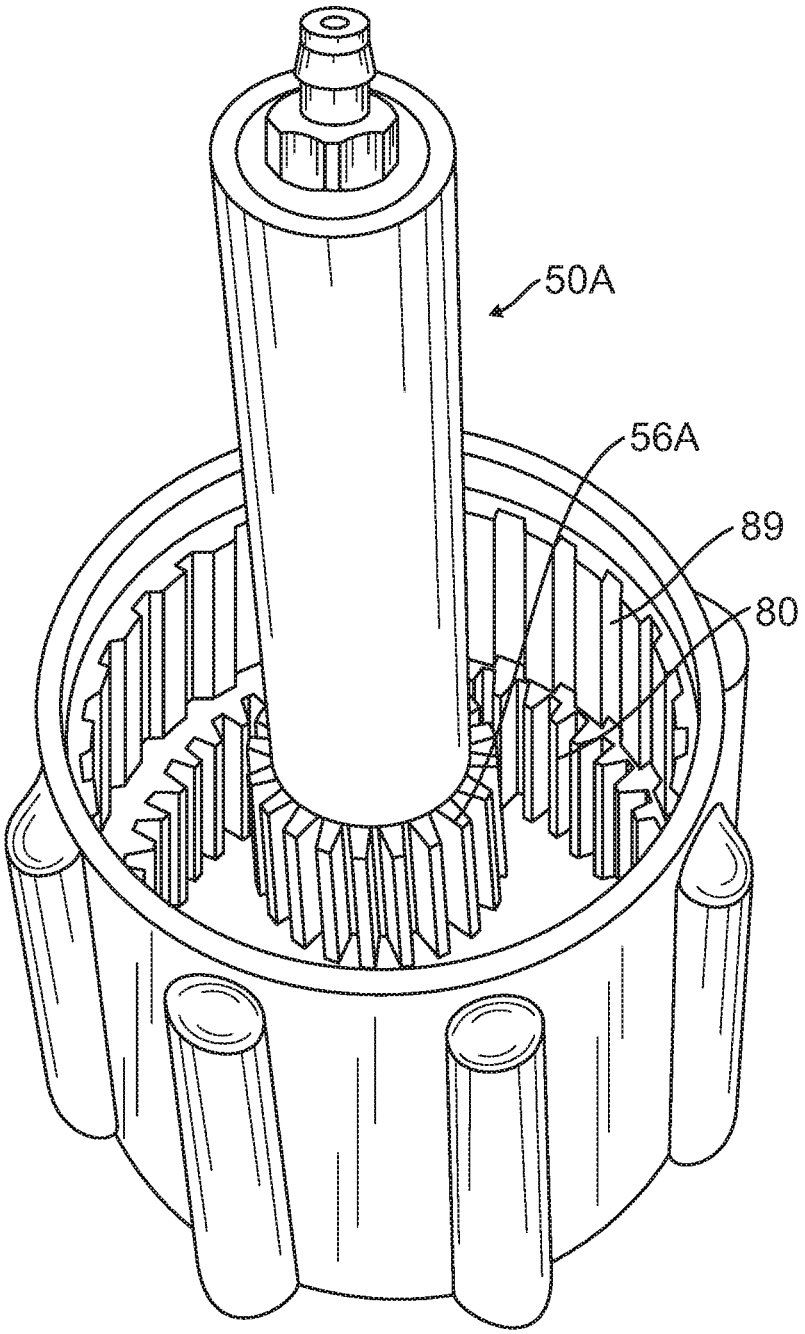
FIG. 5 is a top interior perspective view of the first of two expandable gears positioned inside of the rotatable base with the threaded section of the expandable gear contained entirely within the expandable gear and the threaded base of the expandable gear engaged with interior gear threads on the rotatable base.
Figure 6:
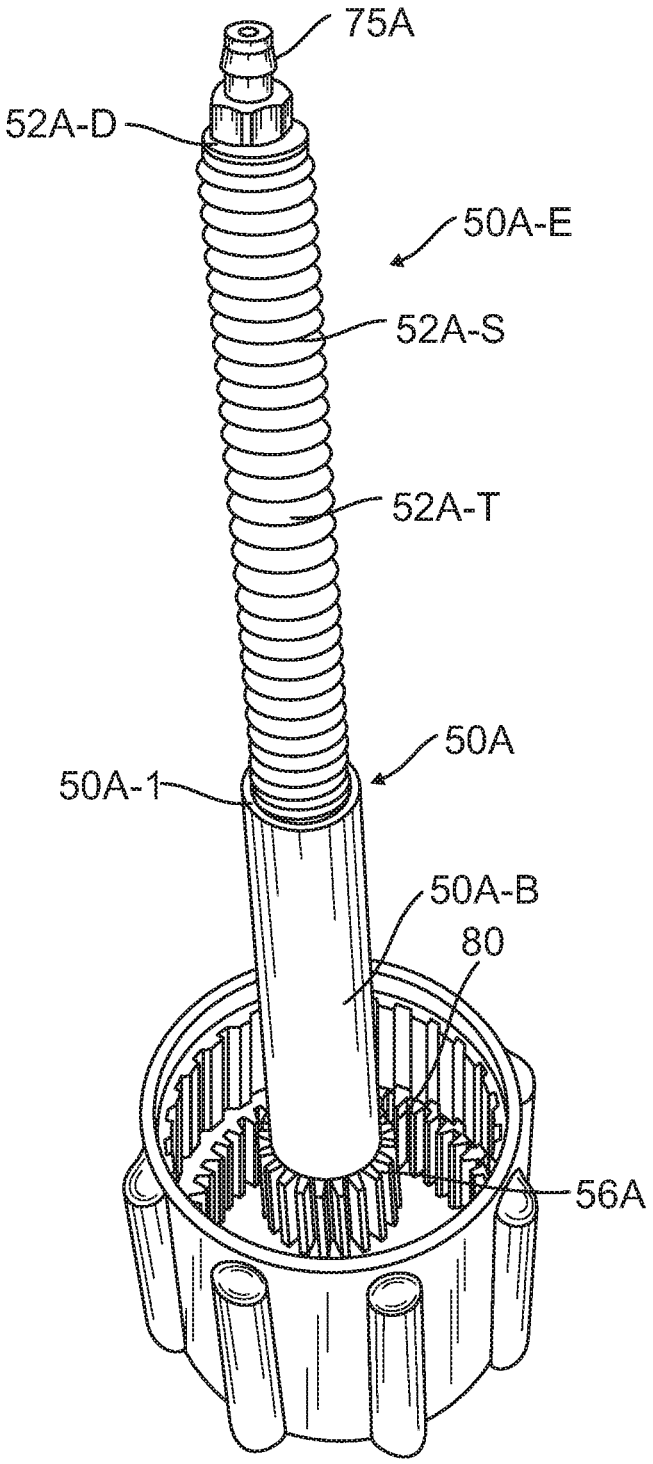
FIG. 6 is a top interior perspective view of the first of two expandable gears positioned inside of the rotatable base with the threaded section of the first expandable gear fully extended out of the expandable gear and the threaded base of the expandable gear engaged with interior gear threads in the rotatable base and also illustrating the approximate distance each longitudinal movable wall will traverse inside of the central main section.

Referring to FIGS. 4A, 4B, 5, and 6, the rotatable base 30 contains base interlocking teeth 80 on the interior circumferential surface 82 adjacent the bottom interior surface 84 within the interior chamber 86 of rotatable base 30. The base interlocking teeth 80 engage with each respective set of interlocking teeth on the bottom circumferential wall of each respective expandable gear. Referring to FIGS. 4A, 5, and 6, first expandable gear 50A has a first main gear body 50A-B with a first exterior sidewall 50A-S. At its first proximal end 52A-P, first main gear body sidewall 50A-S includes a first interlocking gear base section 54AI with first interlocking gear teeth 56A. As illustrated in FIG. 6, first exterior interlocking gear teeth 56A interlock/engage rotatable base interlocking teeth 80. When base 30 is rotated in the clockwise direction, first gear interlocking teeth 56A of first expandable gear 50A also rotate in the clockwise direction. It is also within the spirit and scope of the present invention for the rotation to be counterclockwise.

Referring to FIGS. 4A, 5A, 6, 10A, and 10B, first main gear body 50A-B also has a first interior sidewall 52A-1 (see FIG. 10B) with interior threads 52A-I (see FIG. 10B) encircling first main interior channel 52A-CH (see FIG. 10B). First expandable gear 50A-E includes a first expander member 50A-E having a sidewall 52A-S with first expansion threads 52A-T. First expansion threads 52A-T engage interior threads 50A-I. First expander member 50A-E has a first affixing member 75A at a distal end 52A-D of expander member 50A-E. The first affixing member is affixed to a longitudinally movable rear wall 152A (see FIG. 10A) of first interior main body interior chamber 150A. As the rotatable handle 30 is rotated, first interlocking gear teeth 80 engage with first interlocking gear teeth 56A causing first main gear body 50A-B to rotate in the same direction. This rotation of first main gear body 50A-B causes interior threads 52A-I to rotate, thereby causing first expansion threads 52A-T to rotate and cause first expander member 50A-E to rotate out of first main interior channel 52A-CH. The rotation of the first expander member 50A-E creates a longitudinal pushing force on longitudinally movable rear wall 152A causing it to move into the first interior main body interior chamber 150A. Therefore, any liquid or viscous substance 500 within first interior main body interior chamber 150A is pushed out of the first interior main body interior chamber 150A.

The present invention has a corresponding second interior main body interior chamber 150B which is parallel to the first interior main body interior chamber 150A and separated by a longitudinal interior wall 180.

Referring to FIGS. 7A, 8 and 9, the rotatable base 30 contains interlocking teeth 80 on the interior circumferential surface 82 adjacent the bottom interior surface 84 within the interior chamber 86 of rotatable base 30. The interlocking teeth 80 engage with each respective set of interlocking teeth on the bottom circumferential wall of each respective expandable gear. Second expandable gear 50B has a second main gear body 50B-B with a second exterior sidewall 50B-S. At its first proximal end 50B-P, second main gear body sidewall 50B-S includes a second interlocking gear base section 54BI with second interlocking gear teeth 56B. As illustrated in FIG. 9, second exterior interlocking gear teeth 56B engage rotatable base interlocking teeth 80. When base 30 is rotated in the clockwise direction, second gear interlocking teeth 56B of second expandable gear 50B also rotate in the clockwise direction. It is also within the spirit and scope of the present invention for the rotation to be counter-clockwise.

Second main gear body 50B also has a second interior sidewall 52B-1 (see FIG. 10A) with interior threads 52B-I (see FIG. 10B) encircling second main interior channel 52B-CH (see FIG. 10B). Second expandable gear 50B includes a second expander member 50B-E having a sidewall 52B-S with second expansion threads 52B-T. Second expansion threads 52B-T engage interior threads 52B-I. Second expander member 50B-E has a second affixing member 75B at its distal end 52B-D. The second affixing member is affixed to a second longitudinally movable rear wall 152B (see FIG. 10A) of second interior main body interior chamber 150B. As the rotatable base 30 is rotated, base interlocking gear teeth 80 engage with second interlocking gear teeth 56B causing second main gear body 50B-B to rotate in the same direction. This rotation of second main gear body 50B-B causes interior threads 52B-I to rotate, thereby causing second expansion threads 52B-T to rotate and causing second expander member 52B to rotate out of second main interior channel 52B-CH. The rotation of the second expander member 52B creates a longitudinal pushing force on longitudinally movable rear wall 152B causing it to move into the second interior main body interior chamber 150B. Therefore, any liquid or viscous substance 550 within second interior main body interior chamber 150B is pushed out of the second interior main body interior chamber 150B.

The present invention has a corresponding second interior main body interior chamber 150B which is parallel to the first interior main body interior chamber 150A and separated by a longitudinal interior wall 180 (see FIG. 10B).

Second main gear body 50B-B also has a second interior sidewall 52B-1 with interior threads 52B-I (FIG. 9B) encircling second main interior channel 52B-CH (see FIG. 10B). Second expandable gear 50B includes a second expander member 50B-E having a sidewall 52B-S with second expansion threads 52B-T. Second expansion threads 52B-T engage interior threads 50B-I. Second expander member 50B-E has a second affixing member 75B at its distal end 52B-D. The size of the present invention hand-operated dual chamber product dispensing apparatus 300 has a typical total length of approximately 6.5 inches with the central section having a typical length of 4 inches. Rotatable base 30 has an approximate length of 1.25 inches. It is within the spirit and scope of this invention for the size of the present invention hand-operated dual chamber product dispensing apparatus 300 to be smaller or larger than the typical size.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A mechanically operated substance dispensing apparatus comprising:

a. a central section having an exterior sidewall surrounding an interior chamber, an interior front wall with an interior surface, a nozzle having a body with an interior chamber retaining mixing blades, an opening at a front end of the nozzle, a rear of the nozzle integrally formed with a collar retained at a distal end of the central section;

b. said interior chamber of said central section including a centrally located longitudinal interior dividing wall which extends from adjacent said interior surface of said interior front wall to a location between a first longitudinally movable rear wall and an aligned second longitudinally moveable rear wall;

c. said central section further includes two separate interior sealed and separated product dispensing chambers with a first interior product dispensing chamber bounded by one half of said interior surface, the central longitudinal interior dividing wall, said first longitudinally movable rear wall and said interior surface of a front wall of the central section with a first opening leading to the mixing blades, and the second interior product dispensing chamber bounded by one half of the interior surface, the centrally located longitudinal interior dividing wall, said second longitudinally movable rear wall and the interior surface of the front wall of the central section with a second opening leading to the mixing blades;

d. a rotatable base including an exterior circumferential wall with an interior sidewall surface, an interior chamber bounded by a bottom wall and the interior sidewall having interlocking teeth adjacent the bottom wall, the rotatable base rotatably retained on a proximal end of said central section;

e. said central section further including a gear retaining chamber between the aligned first movable wall and second movable wall and the rotatable base;

f. a first expandable gear within said gear retaining chamber and having a first main gear body with a first exterior sidewall including first exterior interlocking gear teeth adjacent a proximal end of said first main gear body including a first interior sidewall with interior threads encircling a first main interior channel, a first expandable gear including a first expander member having a sidewall with first expansion threads which engage the interior threads on the first interior sidewall, a first affixing member at its distal end affixed to said first longitudinally movable rear wall and the first exterior interlocking gear teeth engaging the rotatable base interlocking teeth; and g. a second expandable gear within said gear retaining chamber and having a second main gear body with a second exterior sidewall including second exterior interlocking gear teeth adjacent a proximal end of said second main gear body including a second interior sidewall with interior threads encircling a second main interior channel, a second expandable gear including a second expander member having a sidewall with second expansion threads which engage the interior threads on the second interior sidewall, a second affixing member at its distal end affixed to said second longitudinally movable rear wall and the second exterior interlocking gear teeth engaging the rotatable base interlocking teeth;

h. wherein as the rotatable base is rotated, base interlocking gear teeth rotate and engage the first exterior interlocking gear teeth of the first main gear and cause it to rotate which causes the first expansion member to rotate and extend out of the first main gear body and push said first longitudinally movable rear wall into the first interior product dispensing chamber up to the interior surface of the first interior wall and simultaneously as the rotatable base is rotated, base interlocking gear teeth rotate and engage the second exterior interlocking gear teeth of the second main gear and cause it to rotate which causes the second expansion member to rotate and extend out of the second main gear body and push said second longitudinally movable rear wall into the second interior product dispensing chamber up to the interior surface of said first interior wall;

i. whereby, a first substance is placed in the first interior product dispensing chamber and a second product is placed in the second interior product dispensing chamber and the first and second substances are pushed into and combined by the mixing blades and exit through the opening in the front opening in the nozzle.

2. The apparatus in accordance with claim 1, further comprising:

a. the proximal end of the central section includes a pair of oppositely disposed teeth retaining clips; and b. the base includes a multiplicity of retaining teeth on its interior sidewall;

c. wherein after the proximal end of the central section is inserted into the rotatable base, the pair of oppositely disposed teeth retaining clips engage the multiplicity of retaining teeth.

3. The apparatus in accordance with claim 1, further comprising:

a. the total length of the apparatus from tip of nozzle to rear of rotatable base is between 6.0 inches and 7.0 inches;

b. the length of the central section is between 3.5 inches and 4.5 inches; and c. the rotatable base is 1.0 and 2.0 inches in length.

4. The apparatus in accordance with claim 1, further comprising: the nozzle is press fit retained onto the central section.

5. The apparatus in accordance with claim 1, further comprising: a removable cap covers the nozzle and its collar.

6. A hand operated substance dispensing apparatus comprising:

a. a central section having an exterior sidewall surrounding an interior chamber, an interior front wall with an interior surface, a nozzle assembly including a body having an interior chamber including interior mixing blades, the nozzle assembly retained at a distal end of the central section;

b. said interior chamber of said central section including a centrally located longitudinal interior dividing wall which extends from adjacent said interior surface of said interior front wall to a location between a first longitudinally movable rear wall and an aligned second longitudinally movable rear wall;

c. said central section further includes two separate interior sealed and separated product dispensing chambers with a first interior product dispensing chamber bounded by one half of said interior surface, the central longitudinal interior dividing wall, said first longitudinally movable rear wall and said interior surface of a front wall of the central section with a first opening leading to said mixing blades, and the second interior product dispensing chamber bounded by one half of the interior surface, the centrally located longitudinal interior dividing wall, said second longitudinally movable rear wall and the interior surface of the front wall of the central section with a second opening leading to said mixing blades;

d. a rotatable base including an exterior circumferential wall with an interior sidewall surface, an interior chamber bounded by a bottom wall and an interior sidewall having interlocking teeth adjacent the bottom wall, the rotatable base rotatably retained on a proximal end of said central section;

e. said central section further including a gear retaining chamber between the aligned first longitudinally movable rear wall and second longitudinally movable wall and the proximal end of the central section adjacent the rotatable base; and f. a first expander gear assembly with a distal end affixed to a the first longitudinally movable rear wall and a first mating gear engaged with said interlocking gears in the rotatable base and a second expander gear assembly with a distal end affixed to the second longitudinally movable rear wall and a first mating gear engaged with said interlocking gears in the rotatable base;

g. wherein rotation of the rotating base causes first expander gear assembly to push first longitudinally movable rear wall to move into the first product dispensing chamber and rotation of the rotating base causes second expander gear assembly to push second longitudinally movable rear wall to move into the first product dispensing chamber;

i. whereby, a first substance is placed in the first interior product dispensing chamber and a second product is placed in the second interior product dispensing chamber and the first and second substances are pushed into and combined by the mixing blades and exit through the opening in the front opening in the nozzle.

7. The apparatus in accordance with claim 6, further comprising a. the first expander gear assembly includes a first expandable gear within said gear retaining chamber and having a first main gear body with a first exterior sidewall including first exterior interlocking gear teeth adjacent a proximal end of said first main gear body including a first interior sidewall with interior threads encircling a first main interior channel, a first expandable gear including a first expander member having a sidewall with first expansion threads which engage the interior threads on the first interior sidewall, a first affixing member at its distal end affixed to said first longitudinally movable rear wall and the first exterior interlocking gear teeth engaging the rotatable base interlocking teeth; and b. the second expander gear assembly includes a second expandable gear within said gear retaining chamber and having a second main gear body with a second exterior sidewall including second exterior interlocking gear teeth adjacent a proximal end of said second main gear body including a second interior sidewall with interior threads encircling a second main interior channel, a second expandable gear including a second expander member having a sidewall with second expansion threads which engage the interior threads on the second interior sidewall, a second affixing member at its distal end affixed to said second longitudinally movable rear wall and the second exterior interlocking gear teeth engaging the rotatable base interlocking teeth;

c. wherein as the rotatable base is rotated, base interlocking gear teeth rotate and engage the first exterior interlocking gear teeth of the first main gear and cause it to rotate which causes the first expansion member to rotate and extend out of the first main gear body and push said first longitudinally movable rear wall into the first interior product dispensing chamber up to the interior surface of the first interior wall and simultaneously as the rotatable base is rotated, base interlocking gear teeth rotate and engage the second exterior interlocking gear teeth of the second main gear and cause it to rotate which causes the second expansion member to rotate and extend out of the second main gear body and push said second longitudinally movable rear wall into the second interior product dispensing chamber up to the interior surface of said first interior wall;

d. whereby, a first substance is placed in the first interior product dispensing chamber and a second product is placed in the second interior product dispensing chamber and the first and second substances are pushed into and combined by the mixing blades and exit through the opening in the front opening in the nozzle.

8. The apparatus in accordance with claim 7, further comprising:

a. the proximal end of the central section includes a pair of oppositely disposed teeth retaining clips; and b. the base includes a multiplicity of retaining teeth on its interior sidewall;

c. wherein after the proximal end of the central section is inserted into the rotatable base, the pair of oppositely disposed teeth retaining clips engage the multiplicity of retaining teeth.

9. The apparatus in accordance with claim 6, further comprising:

a. the total length of the apparatus from tip of nozzle to rear of rotatable base is between 6.0 inches and 7.0 inches;

b. the length of the central section is between 3.5 inches and 4.5 inches; and c. the rotatable base is 1.0 and 2.0 inches in length.

10. The apparatus in accordance with claim 6, further comprising: the nozzle is press fit retained onto the central section.

11. The apparatus in accordance with claim 6, further comprising: a removable cap covers the nozzle and its collar.

12. An apparatus comprising:

a. a nozzle at a distal end of a central section and a rotatable base at a proximal end of said central section, the rotatable base including an interior sidewall having rotatable base interlocking teeth;

b. said central section having an exterior wall with an interior surface surrounding a central section interior chamber divided by a longitudinal dividing wall into separate sealed first interior chamber and second interior chamber each beginning at an interior of a mixing tip and terminating in a respective first rear movable wall and second rear movable wall;

c. a first expander gear having a first main gear body including first exterior interlocking gear teeth adjacent a proximal end with the first exterior interlocking gear teeth engaging the rotatable base interlocking teeth;

d. said first main gear body including a first expander member initially within the first main gear body and extending out of the first main gear body though rotational motion imparted to the base, a first affixing member at the distal end of the first expander member affixed to said first longitudinally movable rear wall, the first main gear body within a central interior chamber of the central section and between the first longitudinally movable rear wall and the rotatable base;

e. a second expander gear having a second main gear body including second exterior interlocking gear teeth adjacent a proximal end with the second exterior interlocking gear teeth engaging the rotatable base interlocking teeth; and f. said second main gear body including a second expander member initially within the second main gear body and extending out of the second main gear body though rotational motion imparted to the base, a second affixing member at a distal end of the second expander member affixed to said second longitudinally movable rear wall, the second main gear body within a central interior chamber within said central section and between the second longitudinally movable rear wall and the rotatable base.

13. The apparatus in accordance with claim 12, further comprising: a first product is movably pushed in the first interior chamber and a second product is movably pushed in the second interior chamber.

14. The apparatus in accordance with claim 13, further comprising: as the rotatable base is rotated, base interlocking gear teeth rotate and engage the first exterior interlocking gear teeth of the first main gear and cause it to rotate which causes the first expansion member to rotate and extend out of the first main gear body and push said first longitudinally movable rear wall into the first interior product dispensing chamber to push the retained first material into said interior mixing tip, simultaneously the rotating base interlocking gear teeth rotate and engage the second exterior interlocking gear teeth of the second main gear and cause it to rotate which causes the second expansion member to rotate and extend out of the second main gear body and push said second longitudinally movable rear wall into the second interior product dispensing chamber to push the retained second material into said interior mixing tip, and force a combined first material and second material out of the nozzle.

15. The apparatus in accordance with claim 14, further comprising: the rotatable base rotates in a direction selected from the group consisting of clockwise and counter-clockwise.

16. The apparatus in accordance with claim 12, further comprising: the nozzle is press fit retained to the central section.

17. A manual mixing apparatus comprising:

a. two separate aligned chambers within a manual mixing apparatus terminating at a front end in a dispensing nozzle and respectively sealed at a proximal end by a respective longitudinally movable wall;

b. a respective expander member within said manual mixing apparatus, each expander member affixed at a proximal end to a respective longitudinally movable wall, each expander member retained in a respective main expansion body, each main expansion body rotatably engaged with a base member at a rear end of the manual mixing apparatus, and a first expander gear having a first main gear body including a first exterior interlocking gear teeth adjacent a proximal end with the first exterior interlocking gear teeth engaging a rotatable base with interlocking teeth, the first main gear body including a first expanded member initially within the first main gear body and extending out of the first main gear body through rotational motion imparted to the base, a first affixing member at the distal end of the first expander member affixed to said first longitudinally movable rear wall, the first main gear body within the central interior chamber between the first longitudinally movable rear wall and the rotatable base; and c. a second expander gear having a second main gear body including second exterior interlocking gear teeth adjacent a proximal end with the second exterior interlocking gear teeth engaging the rotatable base interlocking teeth, and said second main gear body including a second expander member initially within the second main gear body and extending out of the second main gear body though rotational motion imparted to the base, a second affixing member at a distal end of the second expander member affixed to said second longitudinally movable rear wall, the second main gear body within the manual mixing apparatus between the second longitudinally movable rear wall and the rotatable base;

d. wherein a rotation force imparted to the base transfers a rotational motion to each main expansion body, the respective rotation of each main expansion body transfer rotational motion to each respective expander member which imparts longitudinal motion to each longitudinally movable rear wall respectively moving into a respective one of the two separate aligned chambers.

* * * * *